US011421940B2

(12) United States Patent
Liu et al.

(10) Patent No.: US 11,421,940 B2
(45) Date of Patent: Aug. 23, 2022

(54) VAPOR CHAMBER

(71) Applicant: VAST GLORY ELECTRONICS & HARDWARE & PLASTIC(HUI ZHOU) LTD., Hui Zhou (CN)

(72) Inventors: Lei Lei Liu, Hui Zhou (CN); Xue Mei Wang, Hui Zhou (CN)

(73) Assignee: VAST GLORY ELECTRONICS & HARDWARE & PLASTIC(HUI ZHOU) LTD., Hui Zhou (CN)

( * ) Notice: Subject to any disclaimer, the term of this patent is extended or adjusted under 35 U.S.C. 154(b) by 0 days.

(21) Appl. No.: 17/220,248

(22) Filed: Apr. 1, 2021

(65) Prior Publication Data

US 2022/0214115 A1 Jul. 7, 2022

(30) Foreign Application Priority Data

Jan. 4, 2021 (CN) ..... 202110004207.6

(51) Int. Cl.
*F28D 15/02* (2006.01)
*F28D 15/04* (2006.01)

(52) U.S. Cl.
CPC ..... *F28D 15/02* (2013.01); *F28D 15/046* (2013.01)

(58) Field of Classification Search
CPC .... F28D 15/0233; F28D 15/046; F28D 15/02; F28D 15/0275; F28D 2240/00; F28F 2215/06; F28F 3/06
See application file for complete search history.

(56) References Cited

U.S. PATENT DOCUMENTS

2017/0082378 A1* 3/2017 Wang ..... H01L 23/427
2019/0226770 A1* 7/2019 Cheng ..... F28F 3/12
2020/0355444 A1* 11/2020 Chen ..... F28D 15/0283

FOREIGN PATENT DOCUMENTS

CN 108731525 A * 11/2018

* cited by examiner

*Primary Examiner* — Tavia Sullens
*Assistant Examiner* — Khaled Ahmed ali Al Samiri
(74) *Attorney, Agent, or Firm* — Maschoff Brennan

(57) ABSTRACT

A vapor chamber accommodating working fluid and including first plate, second plate, first capillary structure and second capillary structure. First plate has thermal contact surface. Second and first plate are attached to each other so as to allow hermetically sealed space to be formed. Hermetically sealed space accommodates working fluid. Thermal contact surface faces away from hermetically sealed space. First capillary structure is located in hermetically sealed space. First capillary structure includes base portion, first protrusions and second protrusions. Base portion is stacked on first plate. First protrusions and second protrusions protrude from a side of base portion. Second protrusions surround first protrusions. Second capillary structure is located in hermetically sealed space. Second capillary structure is stacked on first protrusions. Distance between first protrusions is smaller than distance between second protrusions. Evaporation space and condensation space are respectively formed on two opposite sides of second capillary structure.

14 Claims, 6 Drawing Sheets

VAPOR CHAMBER

CROSS-REFERENCE TO RELATED APPLICATIONS

This non-provisional application claims priority under 35 U.S.C. § 119(a) on Patent Application No(s). 202110004207.6 filed in China, on Jan. 4, 2021, the entire contents of which are hereby incorporated by reference.

TECHNICAL FIELD

The disclosure relates to a heat-transfer device, more particularly to a vapor chamber.

BACKGROUND

In general, a heat pipe only transfers heat in one dimension (i.e., the axis of the heat pipe), and a vapor chamber can be regard as a planar heat pipe that can transfer heat in two dimensions. The vapor chamber mainly includes a plate body and a capillary structure. The plate body has a chamber filled with a working fluid. The capillary structure is accommodated in the chamber. A part of the plate body that is heated defines an evaporation space of the chamber, and the remaining part of the plate body defines a condensation space of the chamber. The working fluid in the evaporation space is evaporated into vapor, and then flows to the condensation space due to the pressure difference. The working fluid flowing to the condensation space is condensed into liquid and then flows back to the evaporation space with the help of the capillary structure.

However, since the electronic product is required to be light, thin, short and small, it is hard to manage the heat dissipation of the electronic product. Thus, it is desired to enhance the heat dissipation efficiency of the vapor chamber.

SUMMARY

The disclosure provides a vapor chamber with improved heat dissipation efficiency.

One embodiment of this disclosure provides a vapor chamber configured to accommodate a working fluid and including a first plate, a second plate, a first capillary structure and a second capillary structure. The first plate has a thermal contact surface. The second plate and the first plate are attached to each other so as to allow a hermetically sealed space to be formed between the second plate and the first plate. The hermetically sealed space is configured to accommodate the working fluid. The thermal contact surface faces away from the hermetically sealed space. The first capillary structure is located in the hermetically sealed space. The first capillary structure includes a base portion, a plurality of first protrusions and a plurality of second protrusions. The base portion is stacked on the first plate. The plurality of first protrusions and the plurality of second protrusions protrude from a side of the base portion. The plurality of second protrusions surround the plurality of first protrusions. The second capillary structure is located in the hermetically sealed space. The second capillary structure is stacked on the plurality of first protrusions. A distance between the plurality of first protrusions is smaller than a distance between the plurality of second protrusions. An evaporation space and a condensation space are respectively formed on two opposite sides of the second capillary structure.

According to the vapor chamber disclosed by above embodiment, since the first protrusions have small cross sections and are disposed adjacent the thermal contact surface in a dense manner, the heat exchange area of the vapor chamber is increased, thereby enhancing the heat dissipation efficiency of the vapor chamber.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
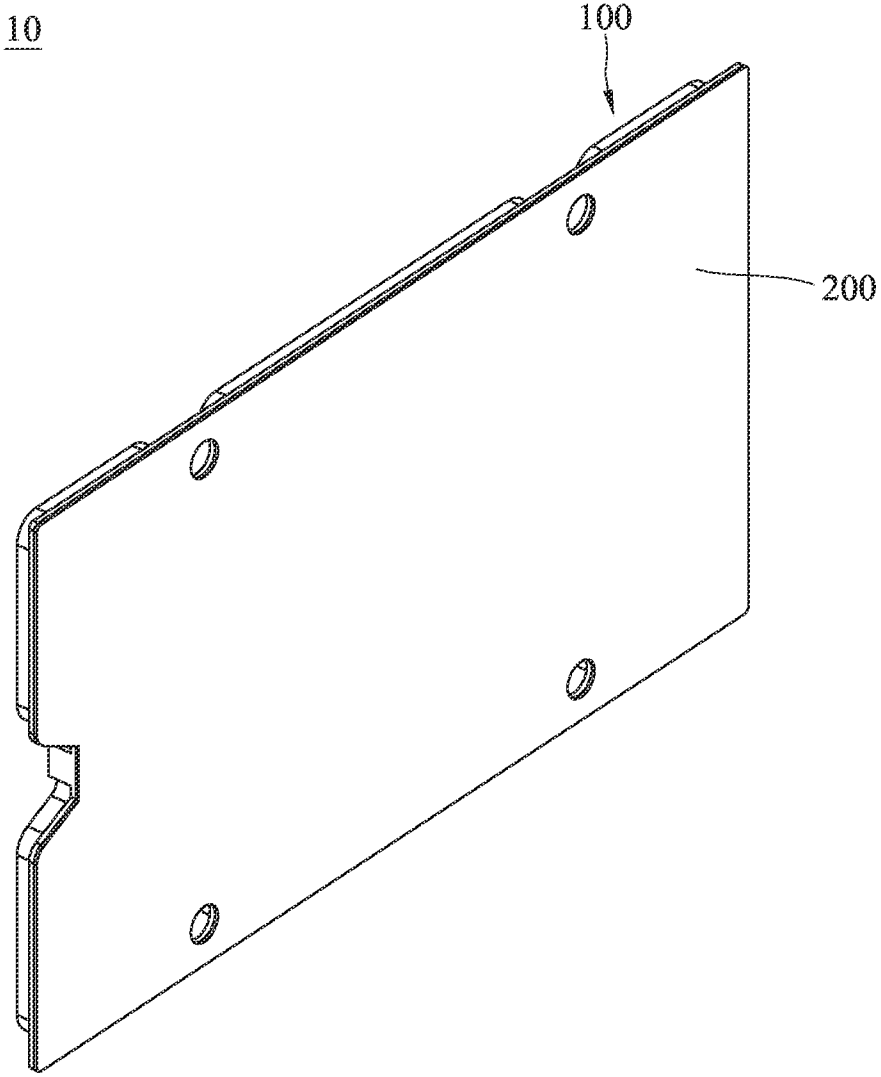
FIG. 1 is a perspective view of a vapor chamber according to a first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
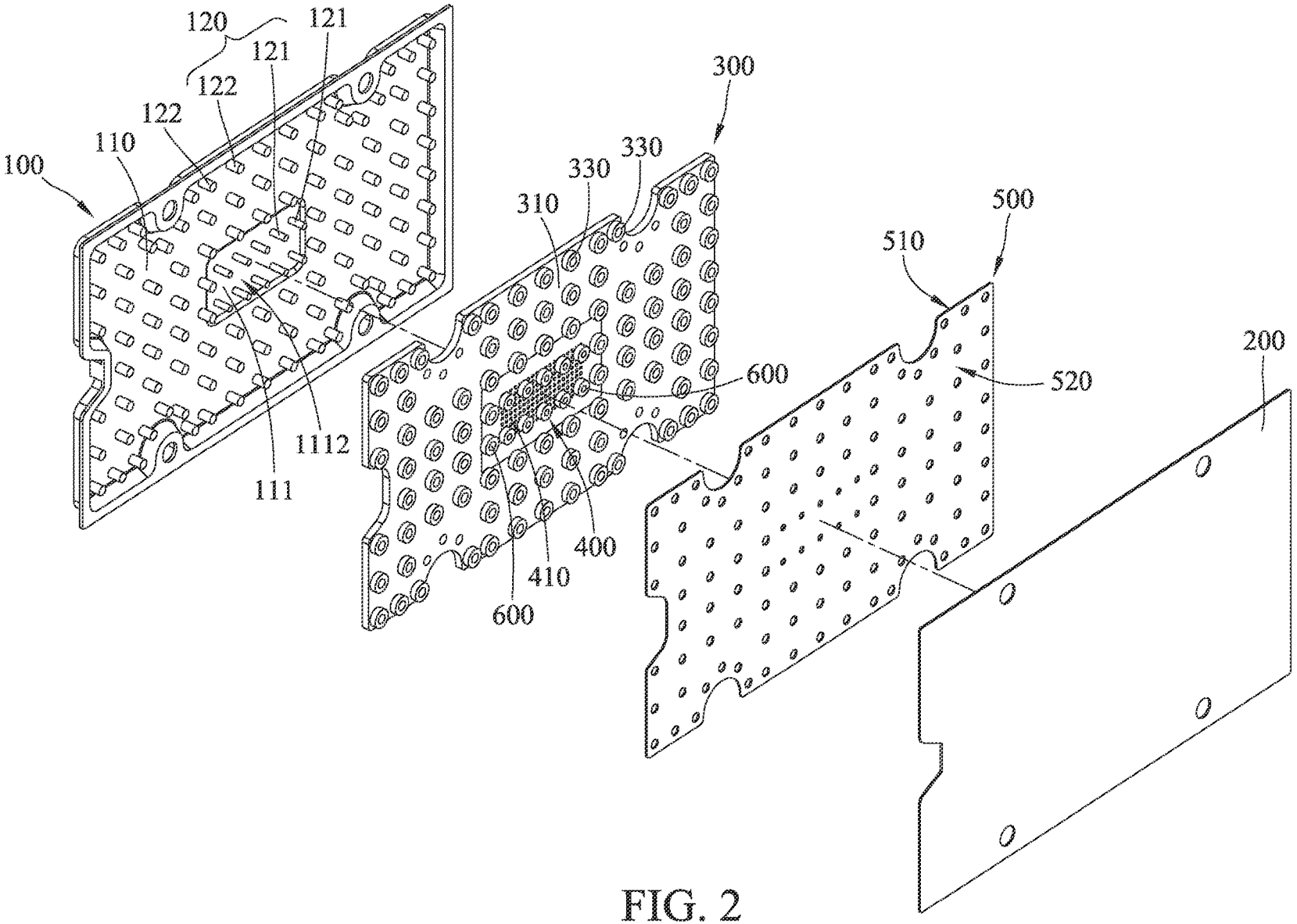
FIG. 2 is an exploded view of the vapor chamber in FIG. 1.
Figure 3:
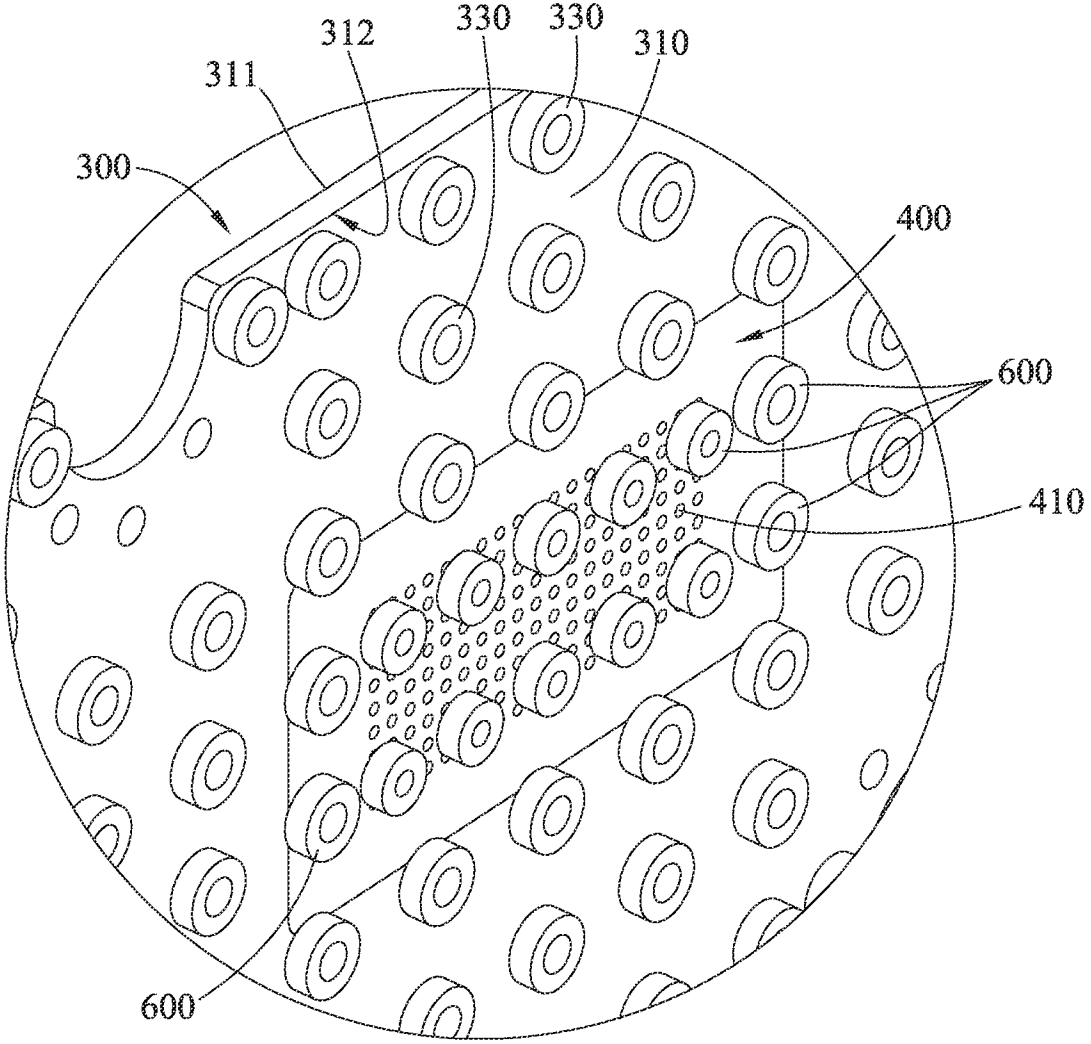
FIG. 3 is a partially enlarged perspective view showing that a first capillary structure, a second capillary structure and a plurality of fourth capillary structures of the vapor chamber in FIG. 2 are stacked.
Figure 4:
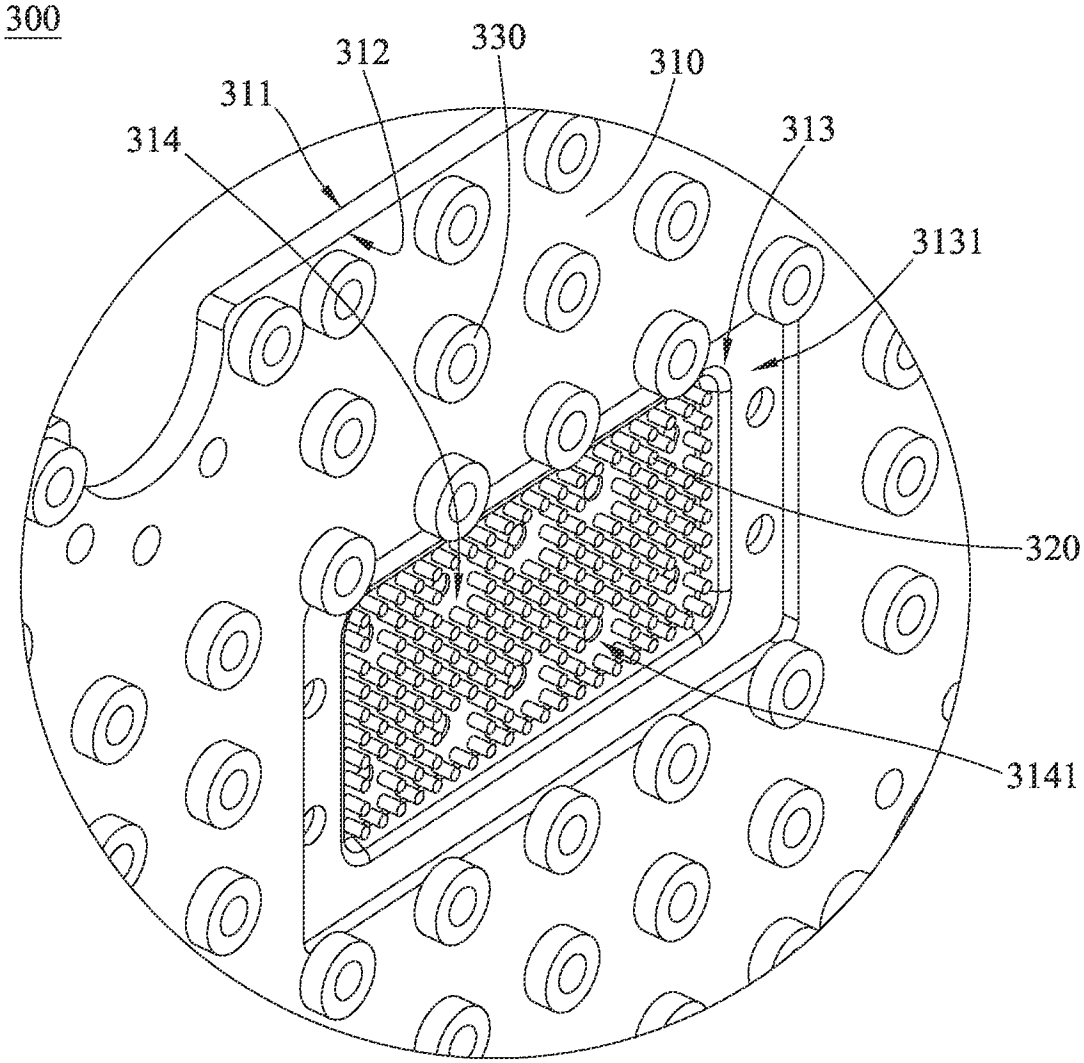
FIG. 4 is a partially enlarged perspective view of the first capillary structure of the vapor chamber in FIG. 2.
Figure 5:
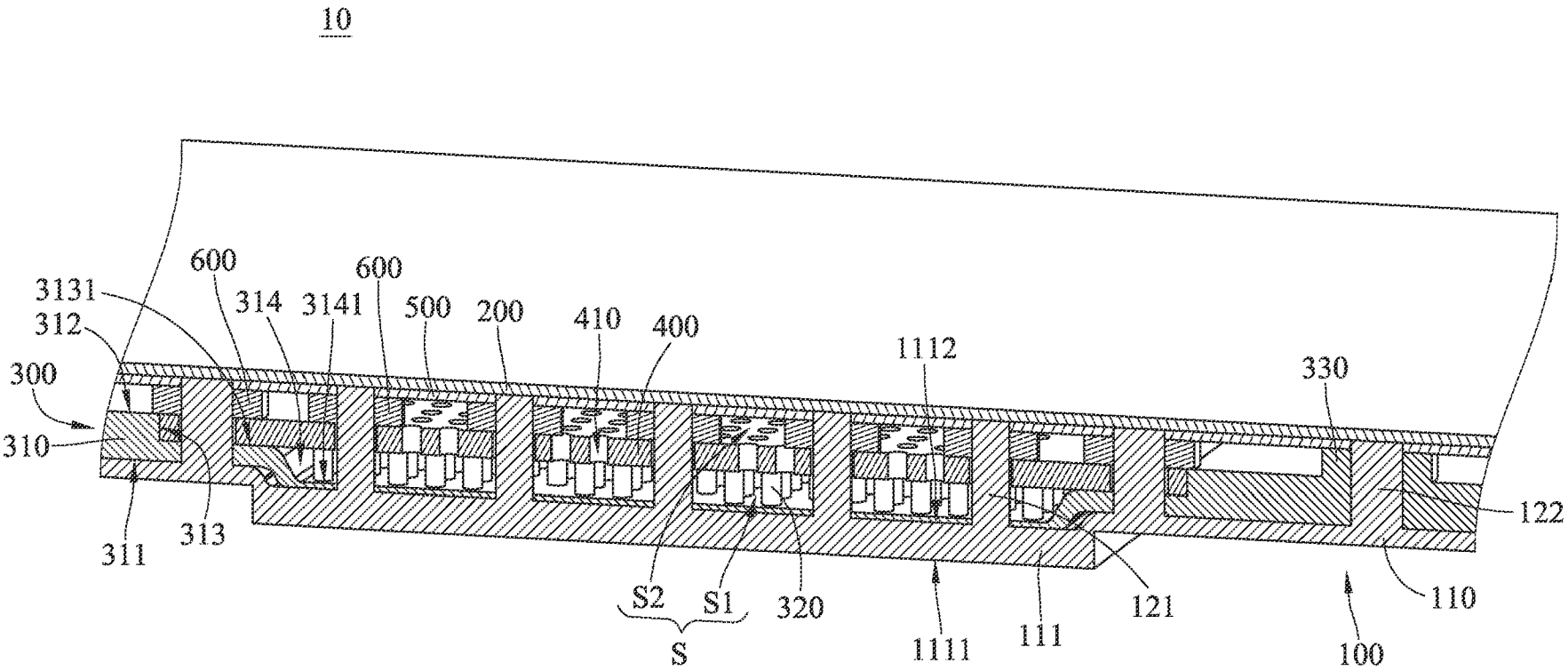
FIG. 5 is a partial cross-sectional view of the vapor chamber in FIG. 1.

Please refer to FIG. 1 to FIGS. 1 to 5. FIG. 1 is a perspective view of a vapor chamber 10 according to a first embodiment of the disclosure. FIG. 2 is an exploded view of the vapor chamber 10 in FIG. 1. FIG. 3 is a partially enlarged perspective view showing that a first capillary structure 300, a second capillary structure 400 and a plurality of fourth capillary structures 600 of the vapor chamber 10 in FIG. 2 are stacked. FIG. 4 is a partially enlarged perspective view of the first capillary structure 300 of the vapor chamber 10 in FIG. 2. FIG. 5 is a partial cross-sectional view of the vapor chamber 10 in FIG. 1.

As shown in FIGS. 1, 2 and 5, in this embodiment, the vapor chamber 10 is configured to accommodate a working fluid (not shown). The working fluid is, for example, water, refrigerant or a fluid that can undergo phase transitions between liquid and gas. The vapor chamber 10 includes a first plate 100, a second plate 200, the first capillary structure 300 and the second capillary structure 400. Further, the vapor chamber 10 may further include a third capillary 500 and the fourth capillary structures 600.

In this embodiment, the first plate 100 is made of, for example, a metal material having high thermal conductivity. The first plate 100 includes a cover part 110 and a plurality of supporting parts 120 protruding from the same side of the cover part 110. In detail, the cover part 110 of the first plate 100 has a protruding structure 111. The protruding structure 111 has a thermal contact surface 1111 protruding from the cover part 110 and a rear surface 1112 recessed from the cover part 110. The rear surface 1112 faces away from the thermal contact surface 1111. The thermal contact surface 1111 is configured to be in thermal contact with a heat source (not shown) so that the heat generated by the heat source can be transferred to the first plate 100 via the thermal contact surface 1111.

The supporting parts 120 includes a plurality of first supporting parts 121 and a plurality of second supporting parts 122. The first supporting parts 121 protrude from the rear surface 1112 of the protruding structure 111. The second supporting parts 122 protrude from the surface of the first plate 100 that surrounds the rear surface 1112. In other words, the second supporting parts 122 surrounds the protruding structure 111. In this embodiment, the first supporting parts 121 and the second supporting parts 122 are in, for example, a cylindrical shape. In addition, a size of radial cross section of each first supporting part 121 is smaller than a size of radial cross section of each second supporting part 122. That is, the first supporting parts 121 is thinner than the second supporting parts 122. The aforementioned size denotes, for example, diameter or perimeter of the radial cross section of the cylinder.

In this embodiment, the first plate 100 is manufactured by a stamping process that is simpler than an etching process. Comparing with using the etching process, using the stamping process to manufacture the first plate 100 can decrease the material cost by about ten to twenty percent of original material cost.

In this embodiment, the first supporting parts 121 and the second supporting parts 122 are in cylindrical shape, but the disclosure is not limited thereto. In other embodiments, the first supporting parts and the second supporting parts may be in a shape of polygonal prism. In addition, the first plate 100 includes the supporting parts 120, but the disclosure is not limited thereto. In other embodiments, the first plate may not include the supporting parts.

The second plate 200 and the cover part 110 of the first plate 100 are attached to each other so as to allow a hermetically sealed space S to be formed between the second plate 200 and the cover part 110. The hermetically sealed space S is configured to accommodate the working fluid (not shown), and the working fluid is configured to absorb the heat transferred from the first plate 100. The protruding structure 111 protrudes away from the second plate 200 and the hermetically sealed space S, and the thermal contact surface 1111 faces away from the hermetically sealed space S.

The first capillary structure 300 is, for example, a sintered powder structure and is located in the hermetically sealed space S. The first capillary structure 300 includes a base portion 310, a plurality of first protrusions 320 and a plurality of second protrusions 330. The base portion 310 is stacked on the first plate 100.

The first protrusions 320 are in, for example, a cylindrical shape and may be directly formed by sintering powder. The second protrusions 330 are in, for example, a ring shape, and allow the powders on a surface of the second supporting parts 122 to sinter together. That is, the second protrusions 330 allow the powders on a surface of metal structure to sinter together. The first protrusions 320 and the second protrusions 330 protrude from the same side of the base portion 310, and the second protrusions 330 surround the first protrusions 320. In detail, the base portion 310 has a first surface 311, a second surface 312, a first recess 313 and a second recess 314. The first surface 311 of the base portion 310 is stacked on the first plate 100. The second surface 312 faces away from the first surface 311. The first recess 313 is recessed from the second surface 312 toward the first surface 311. A bottom surface 3131 of the first recess 313 is recessed toward the first surface 311. In this embodiment, an orthogonal projection of a recessed bottom surface 3141 of the second recess 314 onto a plane where the thermal contact surface 1111 is located is entirely located on the thermal contact surface 1111. That is, the entire of the recessed bottom surface 3141 of the second recess 314 can be orthogonally projected on the thermal contact surface 1111.

The first protrusions 320 protrude from the recessed bottom surface 3141 of the second recess 314, and sides of the first protrusions 320 that are located away from the recessed bottom surface 3141 of the second recess 314 are flush with the recessed bottom surface 3131 of the first recess 313. The second protrusions 330 protrude from the second surface 312 of the base portion 310.

Figure 6:
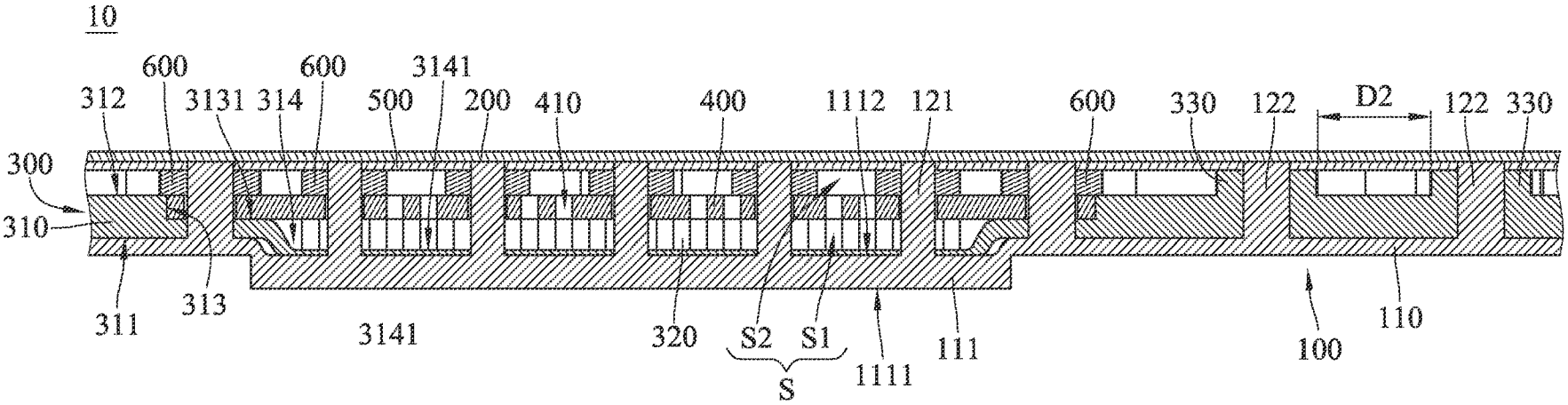
FIG. 6 is a partially enlarged cross-sectional view of the vapor chamber in FIG. 5.
Figure 7:
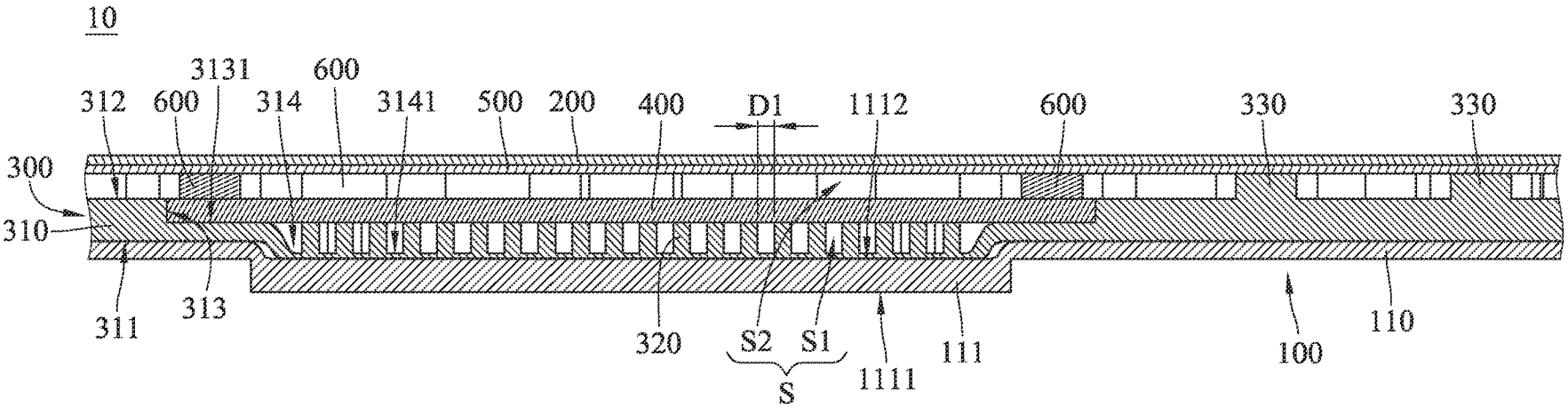
FIG. 7 is another partially enlarged cross-sectional view of the vapor chamber in FIG. 1.

Please refer to FIGS. 6 and 7. FIG. 6 is a partially enlarged cross-sectional view of the vapor chamber in FIG. 5. FIG. 7 is another partially enlarged cross-sectional view of the vapor chamber in FIG. 1. A distance D1 between adjacent two of the first protrusions 320 is smaller than a distance D2 between adjacent two of the second protrusions 330, and a size of a radial cross section of the first protrusions 320 is smaller than a size of a radial cross section of the second protrusions 330. That is, the first protrusions 320 is arranged in a denser manner than the second protrusions 330.

In this embodiment, the distance D1 between adjacent two of the first protrusions 320 is smaller than the distance D2 between adjacent two of the second protrusions 330 so that an overall heat dissipation efficiency of the vapor chamber 10 can be maintained, but the disclosure is not limited thereto. In other embodiments, the distance between adjacent two of the first protrusions may be larger than or equal to the distance between adjacent two of the second protrusions as long as the overall heat dissipation efficiency of the vapor chamber suits the actual requirements.

The second capillary structure 400 is, for example, a sintered powder structure, a sintered ceramic structure, or a metal mesh, and is located in the hermetically sealed space S. The second capillary structure 400 is stacked on the recessed bottom surface 3131 of the first recess 313, and the second capillary structure 400 covers the first recess 313 so that an evaporation space S1 is allowed to be formed between the second capillary structure 400 and the base portion 310 of the first capillary structure 300. In addition, since sides of the first protrusions 320 that are located away from the recessed bottom surface 3141 of the second recess 314 are flush with the recessed bottom surface 3131 of the first recess 313, the second capillary structure 400 is in physical contact with the first protrusions 320 while being stacked on the recessed bottom surface 3131 of the first recess 313. The second capillary structure 400 has a plurality of through holes 410. The through holes 410 are in fluid communication with the evaporation space S1. Also, the orthogonal projections of the through holes 410 of the second capillary structure 400 onto the thermal contact surface 1111 are not overlapped with the orthogonal projections of the first protrusions 320 of the first capillary structure 300 onto the thermal contact surface 1111. That is, the first protrusions 320 do not cover the through holes 410, but the disclosure is not limited thereto. In other embodiments, the first protrusions may partially cover the through holes.

In this embodiment, the second capillary structure 400 is stacked on the recessed bottom surface 3131 of the first recess 313 and is in physical contact with the first protrusions 320, such that the first protrusions 320 support the second capillary structure 400, but the disclosure is not limited thereto. In other embodiments, as long as the structural strength of the second capillary structure is high enough to allow the second capillary structure to be maintain in a flat state, the second capillary structure may be spaced apart from the first protrusions.

In this embodiment, the through holes 410 are, for example, circular holes, but the disclosure is not limited thereto. In other embodiments, the through holes may be polygonal holes or other types of holes.

The third capillary 500 has a first surface 510 and a second surface 520 that face away from each other. The first surface 510 of the third capillary 500 is stacked on the second protrusions 330 of the first capillary structure 300, and a condensation space S2 is formed between the third capillary 500 and the base portion 310 of the first capillary structure 300 and between the third capillary 500 and the second capillary structure 400. The second surface 520 of the third capillary 500 is stacked on the second plate 200. The through holes 410 are in fluid communication with the evaporation space S1 and the condensation space S2.

In this embodiment, the second capillary structure 400 has the through holes 410, but the disclosure is not limited thereto. In other embodiments, as long as the evaporation space S1 and the condensation space S2 may be in fluid communication with each other via other components, the second capillary structure may not have the through hole.

The fourth capillary structures 600 are, for example, sintered powder structures, sintered ceramic structures, or metal meshes. The fourth capillary structures 600 are in, for example, a ring shape and are clamped between the second capillary structure 400 and the third capillary 500.

In this embodiment, the first protrusions 320 are in cylindrical shape, but the disclosure is not limited thereto. In other embodiments, the first protrusions may be in a ring shape or other suitable shapes. Additionally, in this embodiment, the second protrusions 330 of the first capillary structure 300 and the fourth capillary structures 600 are in a ring shape, but the disclosure is not limited thereto. In other embodiments, the second protrusion and the fourth capillary structures may be in a cylindrical shape or other suitable shapes.

In this embodiment, the supporting parts 120 are disposed through the second protrusions 330 of the first capillary structure 300, the second capillary structure 400, the third capillary 500 and the fourth capillary structures 600, and lean on the second plate 200, such that the structural strength of the vapor chamber 10 is enhanced, but the disclosure is not limited thereto.

In this embodiment, the cover part 110 of the first plate 100 has the protruding structure 111, but the disclosure is not limited thereto. In other embodiments, the cover part of the first plate may not have the protruding structure and may be a flat plate. In such embodiments, the function of the protruding structure may be achieved by the thickness difference or height difference between the capillary structures.

According to the vapor chamber disclosed by above embodiments, since the first protrusions have small cross sections and are disposed adjacent the thermal contact surface in a dense manner, the heat exchange area of the vapor chamber is increased. In addition, the first capillary structure has the recess and the second capillary structure covers the recess so as to allow the evaporation space to be formed. Thus, the working fluid in vapor form is separated from the working fluid in liquid form, the working fluid in liquid form is more concentrated, the flowing path of the working fluid in liquid form is shortened, and the flowing speed of the working fluid in liquid form is increased, such that the heat dissipation efficiency of the vapor chamber is enhanced. With such configuration, the vapor chamber according to this disclosure is applicable to a product having a heat flux ranging from 100 to 200 W/cm$^2$.

Further, the first capillary structure, the second capillary structure and the third capillary are connected to one another, and the first capillary structure is a sintered powder structure generating strong capillary force and facilitating the adjustment of the size of the powder particle. Thus, the heat dissipation efficiency of the vapor chamber is further enhanced.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A vapor chamber, configured to accommodate a working fluid, the vapor chamber comprising:

a first plate, having a thermal contact surface;

a second plate, wherein the second plate and the first plate are attached to each other so as to allow a hermetically sealed space to be formed between the second plate and the first plate, the hermetically sealed space is configured to accommodate the working fluid, the thermal contact surface faces away from the hermetically sealed space;

a first capillary structure, located in the hermetically sealed space, wherein the first capillary structure comprises a base portion, a plurality of first protrusions and a plurality of second protrusions, the base portion is stacked on the first plate, the plurality of first protrusions and the plurality of second protrusions protrude from a side of the base portion, and the plurality of second protrusions surround the plurality of first protrusions; and a second capillary structure, located in the hermetically sealed space, the second capillary structure stacked on the plurality of first protrusions;

wherein a distance between the plurality of first protrusions is smaller than a distance between the plurality of second protrusions, and an evaporation space and a condensation space are respectively formed on two opposite sides of the second capillary structure;

wherein the base portion has a first surface, a second surface, a first recess and a second recess, the first surface of the base portion is stacked on the first plate, the second surface faces away from the first surface, the first recess is recessed from the second surface toward the first surface, a recessed bottom surface of the first recess is recessed toward the first surface, the plurality of first protrusions protrude from a recessed bottom surface of the second recess, the plurality of second protrusions protrude from the second surface of the base portion;

wherein an orthogonal projection of the recessed bottom surface of the second recess onto a plane where the thermal contact surface is located is entirely located on the thermal contact surface;

wherein the second capillary structure is stacked on the recessed bottom surface of the first recess, and the second capillary structure covers the first recess so as to allow the evaporation space to be formed between the second capillary structure and the base portion of the first capillary structure.

2. The vapor chamber according to claim 1, wherein sides of the plurality of first protrusions that are located away from the recessed bottom surface of the second recess are flush with the recessed bottom surface of the first recess.

3. The vapor chamber according to claim 1, further comprising a third capillary, wherein the third capillary has a first surface and a second surface that face away from each other, the first surface of the third capillary is stacked on the plurality of second protrusions of the first capillary structure, the condensation space is formed between the third capillary and the base portion of the first capillary structure and between the third capillary and the second capillary structure, the second surface of the third capillary is stacked on the second plate.

4. The vapor chamber according to claim 3, wherein the second capillary structure has a plurality of through holes that are in fluid communication with the evaporation space and the condensation space.

5. The vapor chamber according to claim 4, further comprising a fourth capillary structure that is clamped between the second capillary structure and the third capillary.

6. The vapor chamber according to claim 5, wherein the second protrusions of the first capillary structure and the fourth capillary structure are in a ring shape.

7. The vapor chamber according to claim 4, wherein orthogonal projections of the plurality of through holes of the second capillary structure onto the thermal contact surface are not overlapped with orthogonal projections of the plurality of first protrusions of the first capillary structure onto the thermal contact surface.

8. The vapor chamber according to claim 1, wherein the first plate comprises a cover part and a plurality of supporting parts, the cover part of the first plate and the second plate are attached to each other so as to form the hermetically sealed space, the plurality of supporting parts protrude from a side of the cover part, the plurality of supporting parts are disposed through the first capillary structure and the second capillary structure, and the plurality of supporting parts lean on the second plate.

9. The vapor chamber according to claim 8, wherein the cover part of the first plate has a protruding structure protruding away from the hermetically sealed space, the thermal contact surface is located on a side of the protruding structure that is located away from the hermetically sealed space.

10. The vapor chamber according to claim 9, wherein the protruding structure has a rear surface facing away from the thermal contact surface, the plurality of supporting parts comprise a plurality of first supporting parts and a plurality of second supporting parts, the plurality of first supporting parts protrude from the rear surface of the protruding structure, the plurality of second supporting parts surround the protruding structure, a size of a radial cross section of each of the plurality of first supporting parts is smaller than a size of a radial cross section of each of the plurality of second supporting parts.

11. The vapor chamber according to claim 1, wherein the first capillary structure is a sintered powder structure.

12. The vapor chamber according to claim 1, wherein the second capillary structure is a sintered powder structure, a sintered ceramic structure, or a metal mesh.

13. The vapor chamber according to claim 1, wherein the first plate is manufactured by a stamping process.

14. The vapor chamber according to claim 1, wherein a size of a radial cross section of each of the plurality of first protrusions is smaller than a size of a radial cross section of each of the plurality of second protrusions.

* * * * *